US011052301B2

(12) United States Patent
Farris et al.

(10) Patent No.: US 11,052,301 B2
(45) Date of Patent: Jul. 6, 2021

(54) SECURING GARMENT FOR A SHOULDER-PAD SYSTEM

(71) Applicant: NIKE, Inc., Beaverton, OR (US)

(72) Inventors: Bryan N. Farris, North Plains, OR (US); David Turner, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 435 days.

(21) Appl. No.: 15/480,761

(22) Filed: Apr. 6, 2017

(65) Prior Publication Data

US 2017/0291098 A1 Oct. 12, 2017

Related U.S. Application Data

(60) Provisional application No. 62/319,660, filed on Apr. 7, 2016, provisional application No. 62/319,662, filed
(Continued)

(51) Int. Cl.
*A63B 71/12* (2006.01)
*A41D 1/04* (2006.01)
(Continued)

(52) U.S. Cl.
CPC ..... *A63B 71/12* (2013.01); *A41D 1/04* (2013.01); *A41D 13/0015* (2013.01);
(Continued)

(58) Field of Classification Search
CPC .. A41D 13/015; A41D 13/05; A41D 13/0518; A41D 13/065; A41D 13/0512; A41D 13/0556; A41D 13/0015; A41D 1/04; A41D 13/0562; A41D 2600/10; A63B 2243/007; A63B 2071/1208; A63B 71/12;
(Continued)

(56) References Cited

U.S. PATENT DOCUMENTS 1,310,477 A 7/1919 Thomas
2,545,039 A 3/1951 Mitchel
(Continued)

FOREIGN PATENT DOCUMENTS

CA 2622264 A1 8/2008
CA 2841674 A1 7/2015
(Continued)

OTHER PUBLICATIONS

International Search Report and Written Opinion dated Jul. 11, 2017 in International Patent Application No. PCT/US2017/026614, 16 pages.
(Continued)

*Primary Examiner* — Nathan E Durham
*Assistant Examiner* — Abby M Spatz
(74) *Attorney, Agent, or Firm* — Shook, Hardy & Bacon LLP

(57) ABSTRACT

A shoulder-pad system includes various components, including an impact-plate assembly and one or more sub-layers. The shoulder-pad system may be substantially retained in an arrangement or configuration using one or more securing garments. An exemplary securing garment includes an upper-body garment that at least partially wraps over, and attaches to, the impact-plate assembly.

8 Claims, 14 Drawing Sheets

Related U.S. Application Data on Apr. 7, 2016, provisional application No. 62/319,664, filed on Apr. 7, 2016.

(51) Int. Cl.

| | |
|---|---|
| ***A41D 13/015*** | (2006.01) |
| ***A41D 13/05*** | (2006.01) |
| ***A41D 13/00*** | (2006.01) |
| ***A41F 9/00*** | (2006.01) |
| ***A63B 102/14*** | (2015.01) |
| ***A63B 102/24*** | (2015.01) |

(52) U.S. Cl.

CPC ..... *A41D 13/015* (2013.01); *A41D 13/0512* (2013.01); *A41D 13/0518* (2013.01); *A41D 13/0556* (2013.01); *A41F 9/002* (2013.01); *A41D 13/0562* (2013.01); *A41D 2600/10* (2013.01); *A63B 2071/1208* (2013.01); *A63B 2102/14* (2015.10); *A63B 2102/24* (2015.10); *A63B 2209/10* (2013.01); *A63B 2243/007* (2013.01)

(58) Field of Classification Search

CPC . A63B 71/08; A63B 2102/14; A63B 2102/24; A63B 2209/10; F41H 1/02; A41B 1/00; A41F 9/002

USPC ..... 2/459, 268, 461, 462, 44, 45

See application file for complete search history.

(56) References Cited

U.S. PATENT DOCUMENTS 2,902,695 A 9/1959 Werner
3,064,265 A 11/1962 Bridgewaters et al.
3,452,362 A 7/1969 Korolick et al.
3,561,009 A 2/1971 Huggins
3,740,763 A 6/1973 Mitchell
3,866,241 A 2/1975 Grant
3,867,726 A 2/1975 Owl et al.
3,981,027 A 9/1976 Anderson
4,320,537 A * 3/1982 Mitchell ..... A63B 71/12 2/462
4,467,475 A 8/1984 Gregory et al.
4,554,681 A 11/1985 Kirkland
4,590,622 A * 5/1986 Wolfe ..... A41D 13/0512 2/16
4,698,849 A 10/1987 Mitchell et al.
4,868,925 A 9/1989 Mitchell
4,987,610 A 1/1991 Hunt
5,020,156 A 6/1991 Neuhalfen
5,054,121 A 10/1991 Mitchell
5,065,457 A 11/1991 Henson
5,173,964 A 12/1992 Ball
5,187,812 A 2/1993 Neuhalfen
5,245,706 A 9/1993 Moschetti
5,319,806 A 6/1994 Hermann
5,349,704 A * 9/1994 Masters ..... A41D 13/0015 2/113
5,390,368 A * 2/1995 Chang ..... A63B 71/12 2/45
5,403,268 A 4/1995 Clement
5,530,966 A 7/1996 West
5,623,728 A 4/1997 Wagner
5,742,939 A 4/1998 Williams
5,754,982 A 5/1998 Gainer
5,863,236 A 1/1999 Johnson
6,021,528 A 2/2000 Jurga et al.
6,060,408 A * 5/2000 Monica ..... A63B 71/08 442/65
6,079,056 A 6/2000 Fogelberg
6,088,831 A * 7/2000 Jensen ..... F41H 1/02 2/117
6,202,214 B1 3/2001 Light
6,247,188 B1 6/2001 Beland
6,260,196 B1 7/2001 van der Sleesen
6,389,600 B1 5/2002 Di Maio
6,484,325 B1 11/2002 Lazarus et al.
6,510,559 B1 1/2003 Linares
6,519,775 B1 2/2003 Garcia
6,553,579 B1 4/2003 Gillen et al.
6,709,411 B1 3/2004 Olinger
6,845,522 B2 1/2005 Beland
6,880,347 B1 4/2005 Stam
7,003,803 B1 * 2/2006 Lyden ..... A41D 13/0153 2/22
7,854,026 B2 12/2010 Phaneuf et al.
7,871,388 B2 1/2011 Brown
7,882,576 B2 2/2011 Morrow et al.
8,015,621 B2 9/2011 Udelhofen
8,082,602 B2 12/2011 Crelinsten et al.
8,221,291 B1 7/2012 Kantarevic
8,336,124 B2 12/2012 Crelinsten et al.
8,533,871 B2 9/2013 Fiegener et al.
8,818,478 B2 8/2014 Scheffler et al.
8,850,613 B2 10/2014 Kordecki
8,869,315 B2 10/2014 Contant et al.
8,869,316 B2 10/2014 Lewis
10,646,769 B1 5/2020 Farris et al.
2004/0003448 A1 1/2004 Morrow et al.
2004/0210992 A1 10/2004 Morrow et al.
2005/0102741 A1 5/2005 McQueer
2006/0048292 A1 3/2006 Gillen et al.
2006/0053535 A1 3/2006 Ide et al.
2007/0050886 A1 3/2007 Brassill
2007/0151004 A1 7/2007 Brassill
2007/0199129 A1 8/2007 Davis
2008/0313793 A1 12/2008 Skottheim et al.
2009/0235440 A1 9/2009 Udelhofen
2009/0271916 A1 11/2009 Harris
2009/0282609 A1 11/2009 Kotoske
2010/0088808 A1 4/2010 Rietdyk et al.
2010/0192287 A1 * 8/2010 Kraemer ..... A41D 13/0512 2/459
2010/0210985 A1 8/2010 Kuorak et al.
2010/0242158 A1 9/2010 Blakely et al.
2011/0239355 A1 10/2011 Lee
2011/0247130 A1 10/2011 Lewandowski
2011/0277212 A1 11/2011 Jones
2011/0277226 A1 11/2011 Turner
2012/0198606 A1 8/2012 Bowden et al.
2012/0255094 A1 10/2012 Dragony
2012/0311774 A1 12/2012 Chen et al.
2013/0014318 A1 1/2013 Jourde et al.
2013/0036537 A1 2/2013 Reynolds et al.
2013/0232653 A1 9/2013 Conca
2013/0274587 A1 10/2013 Coza et al.
2014/0201883 A1 7/2014 Achtymichuk
2015/0000003 A1 1/2015 Blakely et al.
2015/0033451 A1 2/2015 Bradshaw
2015/0101110 A1 4/2015 Wagner et al.
2015/0157484 A1 6/2015 Ex-lubeskie et al.
2015/0157917 A1 6/2015 Gennario, Jr.
2015/0181950 A1 7/2015 Skottheim et al.
2015/0216240 A1 8/2015 Martel
2015/0237924 A1 8/2015 Cosio
2015/0264987 A1 9/2015 Morin et al.
2017/0340950 A1 11/2017 Farris et al.

FOREIGN PATENT DOCUMENTS

CN 2172964 Y 8/1994
CN 2243792 Y 1/1997
CN 201097635 Y 8/2008
CN 201111354 Y 9/2008
CN 102987590 A 3/2013
CN 104955347 A 9/2015
DE 20215653 U1 1/2003
EP 1080647 A2 3/2001
JP 3175831 U 5/2012
WO 2015153343 A1 10/2015

(56) References Cited

FOREIGN PATENT DOCUMENTS

OTHER PUBLICATIONS

International Search Report and Written Opinion dated Jul. 11, 2017 in International Patent Application No. PCT/US2017/026589, 17 pages.
Non-Final Office Action dated Jan. 28, 2019 in U.S. Appl. No. 15/481,304, 56 pages.
Non-Final Office Action dated Aug. 27, 2019 in U.S. Appl. No. 15/481,304, 39 pages.
Non-Final Office Action dated Sep. 5, 2019 in U.S. Appl. No. 15/481,146, 16 pages.
International Search Report and Written Opinion dated Sep. 14, 2017 in International Patent Application No. PCT/US2017/026601, 22 pages.
"Neoprene shoulder support brace compression effective shoulder guard," Alibaba®, wholesaler.alibaba.com, accessed: Dec. 2015. http://wholesaler.alibaba.com/product-detail/Neoprene-shoulder-support-bracebelt-unisex_60340437466.html?spm=a2700.7724857.29.82.JdFwmm.
"Featured Lacross Items: Hot Seller—STX Impact Shoulder Pads," Play It Again Sports®, playitagainsportsstmatthews.com, accessed: Dec. 2015. http://www.playitagainsportsstmatthews.com/equipment/category/7466.
"Mcdavid Light Shoulder Support," Amazon, amazon.com, ASIN: B002DPBH4S, accessed: Dec. 2015. http://www.amazon.com/McDavid-463R-Mcdavid-Shoulder-Support/dp/B002DPBH4S/ref=pd_sim_200_3?ie=UTF8&dpID=41o35rXbwwL&dpSrc=sims&preST=_AC_UL160_SR160%2C160_&refRID=0R4DNBSTXY2G7QNCKPZZ.
International Preliminary Report on Patentability dated Oct. 18, 2018 in International Patent Application No. PCT/US2017/026589, 10 pages.
International Preliminary Report on Patentability dated Oct. 18, 2018 in International Patent Application No. PCT/US2017/026601, 12 pages.
International Preliminary Report on Patentability dated Oct. 18, 2018 in International Patent Application No. PCT/US2017/026614, 9 pages.
Final Office Action received for U.S. Appl. No. 15/481,304, dated Feb. 18, 2020, 39 pages.
Intention to Grant received for European Patent Application No. 17719975.9, dated Jan. 16, 2020, 6 pages.
Intention to Grant received for European Patent Application No. 17721232.1, dated Jan. 17, 2020, 6 pages.
Notice of Allowance received for U.S. Appl. No. 15/481,146, dated Feb. 25, 2020, 7 pages.
Non-Final Office Action received for U.S. Appl. No. 15/481,304, dated Jun. 10, 2020, 18 pages.
Extended European Search Report received for European Patent Application No. 20176105.3, dated Aug. 28, 2020, 9 pages.
Final Office Action received for U.S. Appl. No. 15/481,304, dated Sep. 29, 2020, 18 pages.
Notice of Allowance received for U.S. Appl. No. 15/481,304, dated Feb. 2, 2021, 8 pages.

* cited by examiner

SECURING GARMENT FOR A SHOULDER-PAD SYSTEM

CROSS-REFERENCE TO RELATED APPLICATIONS

This application claim claims priority to U.S. Provisional Application No. 62/319,660, filed Apr. 7, 2016, titled "Securing Garment for a Shoulder-Pad System," and further claims priority to U.S. Provisional Application No. 62/319,662, filed Apr. 7, 2016, titled "Impact-Attenuation Sub-Layer for a Shoulder-Pad System," and further claims priority to U.S. Provisional Application No. 62/319,664, filed Apr. 7, 2016, titled "Discrete Shoulder Sleeve for a Shoulder-Pad System". The entireties of the aforementioned applications are incorporated by reference herein.

TECHNICAL FIELD

This disclosure describes a shoulder-pad system and sub-components thereof, including a securing garment.

BACKGROUND

Shoulder pads are utilized in various contexts to provide protection from impact to a wearer. For example, shoulder pads are often worn in American style football, hockey, lacrosse, and motocross, among other activities. Some styles of shoulder pads include various drawbacks, such as restricted range-of-motion, which may limit the ability of a wearer to fully extend his or her arms directly overhead. In addition, some styles of shoulder pads may be too bulky or may necessitate constant readjustment after being impacted. These are only some of the exemplary issues presented by some typical shoulder pads.

BRIEF DESCRIPTION OF THE DRAWINGS

The present invention is described in detail herein with reference to the attached drawing figures, which are incorporated herein by reference, wherein.

DETAILED DESCRIPTION

Figure 1:
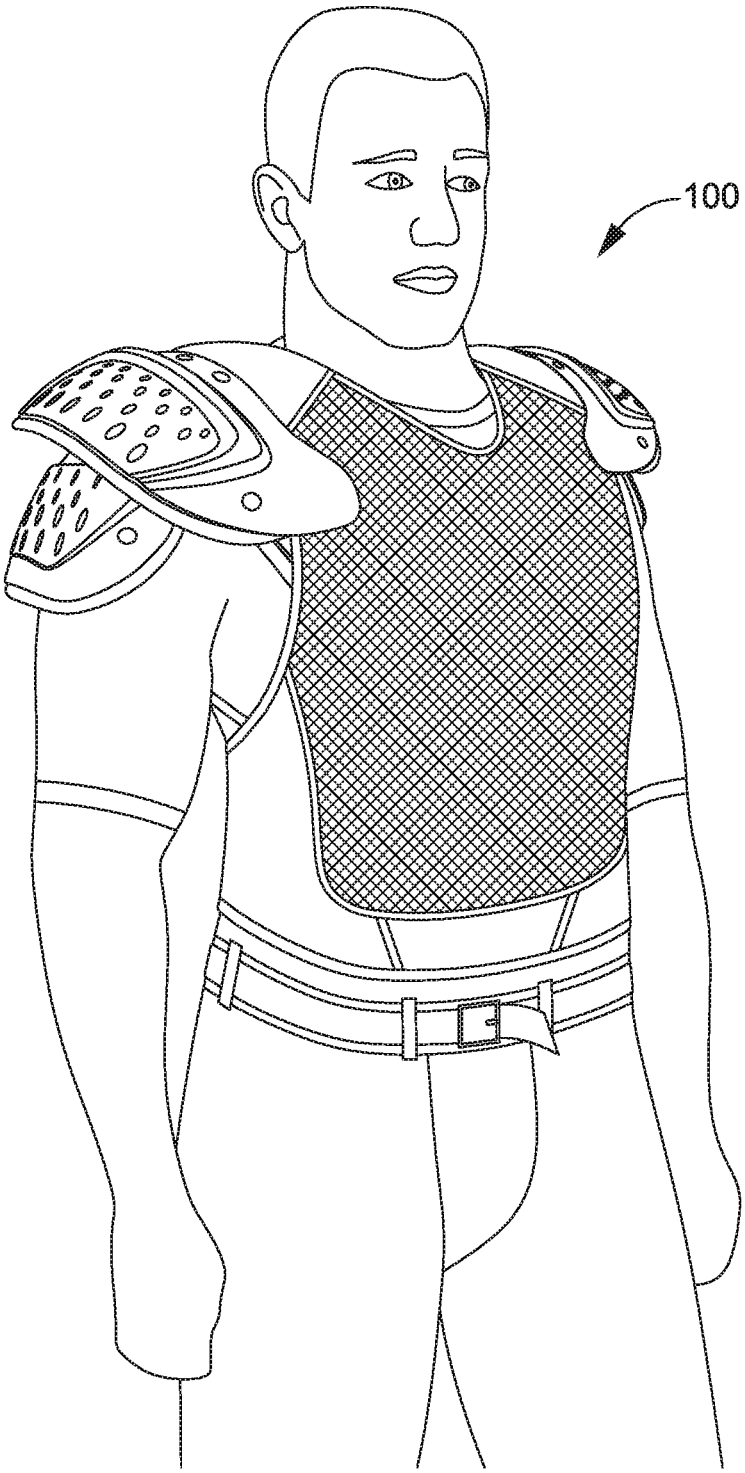
FIG. 1 depicts a perspective view of an exemplary shoulder-pad system in an as-worn position in accordance with an aspect hereof.

Subject matter is described throughout this disclosure in detail and with specificity in order to meet statutory requirements. But the aspects described throughout this disclosure are intended to be illustrative rather than restrictive, and the description itself is not intended necessarily to limit the scope of the claims. Rather, the claimed subject matter might be practiced in other ways to include different elements or combinations of elements that are equivalent to the ones described in this disclosure. In other words, the intended scope of the claims, and the other subject matter described in this specification, includes equivalent features, materials, methods of construction, and other aspects not expressly described or depicted in this application in the interests of concision, but which would be understood by an ordinarily skilled artisan in the relevant art in light of the full disclosure provided herein as being included within the inventive scope. It will be understood that certain features and sub-combinations are of utility and may be employed without reference to other features and subcombinations. This is contemplated by and is within the scope of the claims.

Throughout this description, the term "as-worn position" will be used when discussing the orientation of the disclosed shoulder-pad system. The as-worn position of the shoulder-pad system denotes the position the shoulder-pad system is, and subcomponents thereof are, in when donned by a wearer. Hence, in the as-worn position, a shirt will be oriented such that a neck opening will be at the top of the shirt and near the upper end of the wearer's torso. Similarly, in the as-worn position, a lower-body garment, such as a pair of pants, will be oriented such that a waist opening will be at the top of the pants and near the waist of the wearer. However, the subject matter is described in an as-worn position merely to assist the reader in understanding relative terminology and should not be implied to require a human being (or other living being) to understand or interpret the subject matter of this disclosure.

As used throughout this disclosure, the terms "securing" or "affixing" mean either releasably or permanently attaching objects together using affixing technologies such as stitching, bonding, welding, hook-and-loop fasteners, buttons, snaps, and the like.

Generally, aspects of this disclosure describe a shoulder-pad system having various subcomponents, such as a base-layer garment, an impact-attenuation sub-layer, and an impact-plate assembly. In addition, the system may include one or more garments that are wearable to secure the base-layer garment, the impact-attenuation sub-layer, the impact-plate assembly, and any combination thereof. For example, the system may include an upper-body securing garment that attaches over the impact-plate assembly and that is configured to secure the impact-plate assembly in a desired position or arrangement.

The securing garment may be configured to wrap over, or at least partially encase, one or more plates of the shoulder-pad system. Further, the securing garment may include portions that are anchored to the shoulder-pad system and that are coupled, directly or indirectly, to the wearer, such that the securing garment assists with holding the shoulder-pad system in a desired position relative to the wearer.

In one aspect, an upper-body garment is disclosed. The upper-body garment may comprise an anterior panel connected to a posterior panel by a pair of shoulder portions. The anterior panel, posterior panel and the pair of shoulder portions may each include a respective collar portion forming a perimeter around a neck-receiving opening. The upper-body garment may include a collar tab that extends radially outward from the neck-receiving opening and may be layered under the respective collar portions. The collar tab may include a first portion of one or more fasteners configured to releasably couple to a second portion of one or more fasteners affixed to an impact-plate assembly (such as described below). The upper-body garment may further comprise one or more first and second lateral panels coupled to at least one of the anterior panel, the posterior panel, or a combination thereof. The one or more first and second lateral panels may include a first and second releasable fastener, respectively.

In another aspect, a shoulder-pad system is disclosed. The shoulder-pad system may comprise an upper-body garment (such as described above) configured to couple to, and be worn over, an impact-plate assembly (such as shoulder pads). The impact-plate assembly may include an anterior plate portion, a posterior plate portion, a first shoulder assembly and a second shoulder assembly. The anterior plate portion may include one or more first garment anchors. The one or more first garment anchors may be configured to couple with the one or more first and second lateral panels of the upper-body garment. The first and second shoulder assemblies may include a first and a second arched frame, respectively, and each of the arched frames may include a convex, crown-side surface. The anterior plate portion, the posterior plate portion, and the first and second arched frames each may include a respective plate collar portion forming a plate perimeter edge around a plate neck-receiving opening. In the as-worn position, the collar tab of the upper-body garment may wrap around the plate perimeter edge, extend through the plate neck-receiving opening and along an underneath surface of the respective plate collar portions. The underneath surface may include a second portion of the one or more fasteners configured to releasably couple to the first portion of the one or more fasteners coupled to the collar tab.

Another aspect of the disclosure includes a shoulder-pad system having a set of shoulder pads, an upper-body garment, and a first and second discrete shoulder sleeves. The set of shoulder pads includes an anterior plate portion, a posterior plate portion, a first shoulder assembly, and a second shoulder assembly, and the anterior plate portion includes one or more first garment anchors. Further, the first and second shoulder assemblies include first and second arched frames, respectively, and a first and second epaulette plate, respectively. The upper-body garment fits over, and at least partially covers, the set of shoulder pads, and includes an anterior panel, a posterior panel, and shoulder portions. The anterior panel at least partially covers the anterior plate portion, and the posterior panel at least partially covers the posterior plate portion. In addition, the posterior panel is connected to the anterior panel by a first shoulder portion and a second shoulder portion, the anterior panel, the posterior panel, and the first and second shoulder portions each including a respective garment collar portion forming a garment perimeter edge around a garment neck-receiving opening. In addition, the first shoulder portion of the upper-body garment wraps over the first arched frame of the first shoulder assembly and is layered over the convex, crown-side surface of the first arched frame, and similarly the second shoulder portion of the upper-body garment wraps over the second arched frame of the second shoulder assembly and is layered over the convex, crown-side surface of the second arched frame. The upper-body garment includes one or more second garment anchors configured to releasably attach to the one or more first garment anchors. The first discrete shoulder sleeve is removably attachable to the first epaulette plate, and the second discrete shoulder sleeve is removably attachable to the second epaulette plate. The first and second discrete shoulder sleeves each include an epaulette attachment mechanism that releasably attaches to a respective epaulette and a shoulder pocket coupled with the epaulette attachment mechanism. The shoulder pocket includes one or more textile panels coupled to one another to form a cavity, the one or more textile panels at least partially encasing the epaulette when the epaulette is positioned in the cavity. Each of the discrete shoulder sleeves also includes a cuff coupled to the shoulder pocket and including a band of textile forming a tubular body. The first and second discrete shoulder sleeves are detached from the upper body garment.

Having generally described various aspects of the disclosure, reference will now be made to the various figures.

Aspects of an Exemplary Shoulder-Pad System

As previously indicated, this disclosure generally describes a shoulder-pad system that may be used to attenuate impact in various contexts, such as in American-style football, lacrosse, hockey, motocross, and the like, and an exemplary shoulder-pad system 100 is illustrated in FIG. 1 in an as-worn configuration. The shoulder-pad system 100 is depicted in FIG. 1 in a partially assembled arrangement, and as will be described in subsequent portions of this disclosure, the shoulder-pad system 100 includes a number of subcomponents that are combinable in different arrangements to construct various portions of the shoulder-pad system 100. The shoulder-pad system 100 includes certain features and functionality that arise from the shoulder-pad system 100 as a whole. In addition, the subcomponents each include certain features and functionality that arise from the sub-component independently, as well as the synergistic interaction of the sub-component with one or more other subcomponents.

Figure 2:
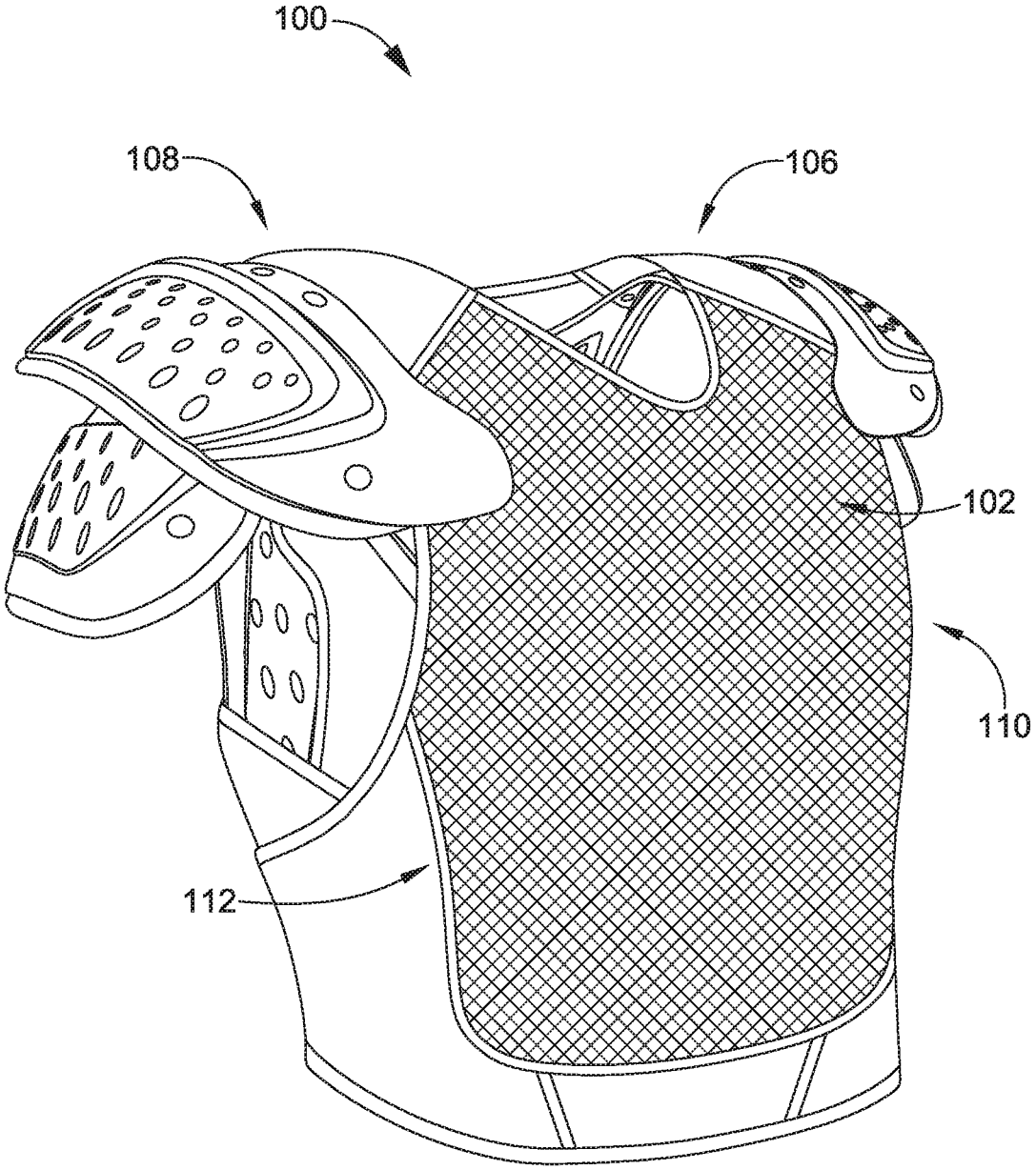
FIG. 2 depicts a perspective view of an exemplary shoulder-pad system in accordance with an aspect hereof.
Figure 3:
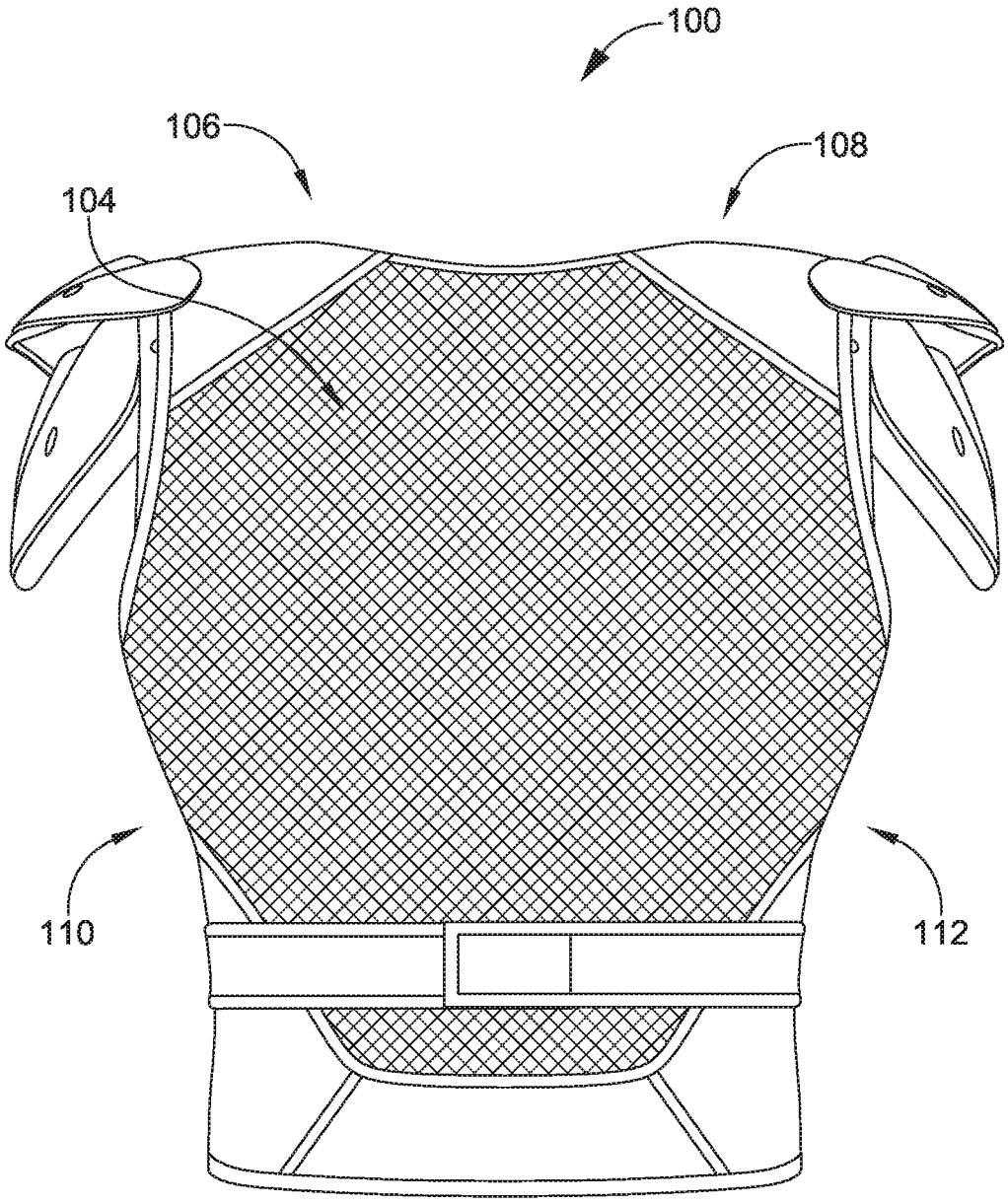
FIG. 3 depicts a rear elevation of an exemplary shoulder-pad system in accordance with an aspect hereof.

Referring now to FIGS. 2 and 3, the shoulder-pad system 100 generally includes a yoke-like arrangement with a front and a back coupled by shoulder portions. The front, the back, and the shoulder portions define a neck-receiving opening, and in order to don or wear the shoulder-pad system 100, a person's head and neck are passed through the neck-receiving opening, such that the shoulder portions are supported on his or her shoulders. The shoulder-pad system 100 generally functions to attenuate impacts or forces to which shoulder-pad system 100 may be subjected.

When describing various aspects of the shoulder-pad system 100, relative terms may be used to aid in understanding relative relationships. For instance, the shoulder-pad system 100 may be divided into an anterior region 102 that generally corresponds with a chest and/or abdomen of a wearer, and a posterior region 104 that generally correspond with a back of a wearer, such as a cervical region, thoracic region, lumbar region, and or scapula region. Both the anterior region 102 and the posterior region 104 may include medial portions and lateral portions, the medial portions being positioned relatively more towards a vertical mid-line (based on the orientation of the system as depicted in FIG. 1) than the lateral portions. The lateral portions may include a left-lateral portion 110 and a right-lateral portion 112. In addition, both the anterior region 102 and the posterior region 104 may include inferior portions and superior portions, the inferior portions being oriented lower than the superior portions, based on the orientation of the system as depicted in FIG. 1. Furthermore, the shoulder-pad system 100 may include shoulder regions that bridge the anterior portion(s) 102 to the posterior portion(s) 104 and that generally correspond with the shoulder of a wearer. The shoulder regions include a left-shoulder region 106 that corresponds with a left laterality and a right-shoulder region 108 that corresponds with a right laterality.

The relative areas 102, 104, 106, 108, 110, and 112 are not intended to demarcate precise areas of the shoulder-pad system 100. Rather, the relative areas 102, 104, 106, 108, 110, and 112 are intended to represent general areas of the shoulder-pad system 100 to aid in understanding the various descriptions provided in this disclosure. In addition, it is understood that a portion of the shoulder-pad system 100 may include multiple regions or areas. For example, the anterior region 102 may extend through both the right-lateral side 112, the medial area, and the left-lateral side 110. And the left-lateral side 110 may include portions of both the anterior region 102 and the posterior region 104. The relative areas 102, 104, 106, 108, 110, and 112 are provided for explanatory and illustrative purposes and are not meant to depend on a human being for interpretive purposes. Accordingly, some aspects herein may be described as corresponding to a left front quadrant, a right front quadrant, a left rear quadrant, and/or a right rear quadrant.

Figure 4:
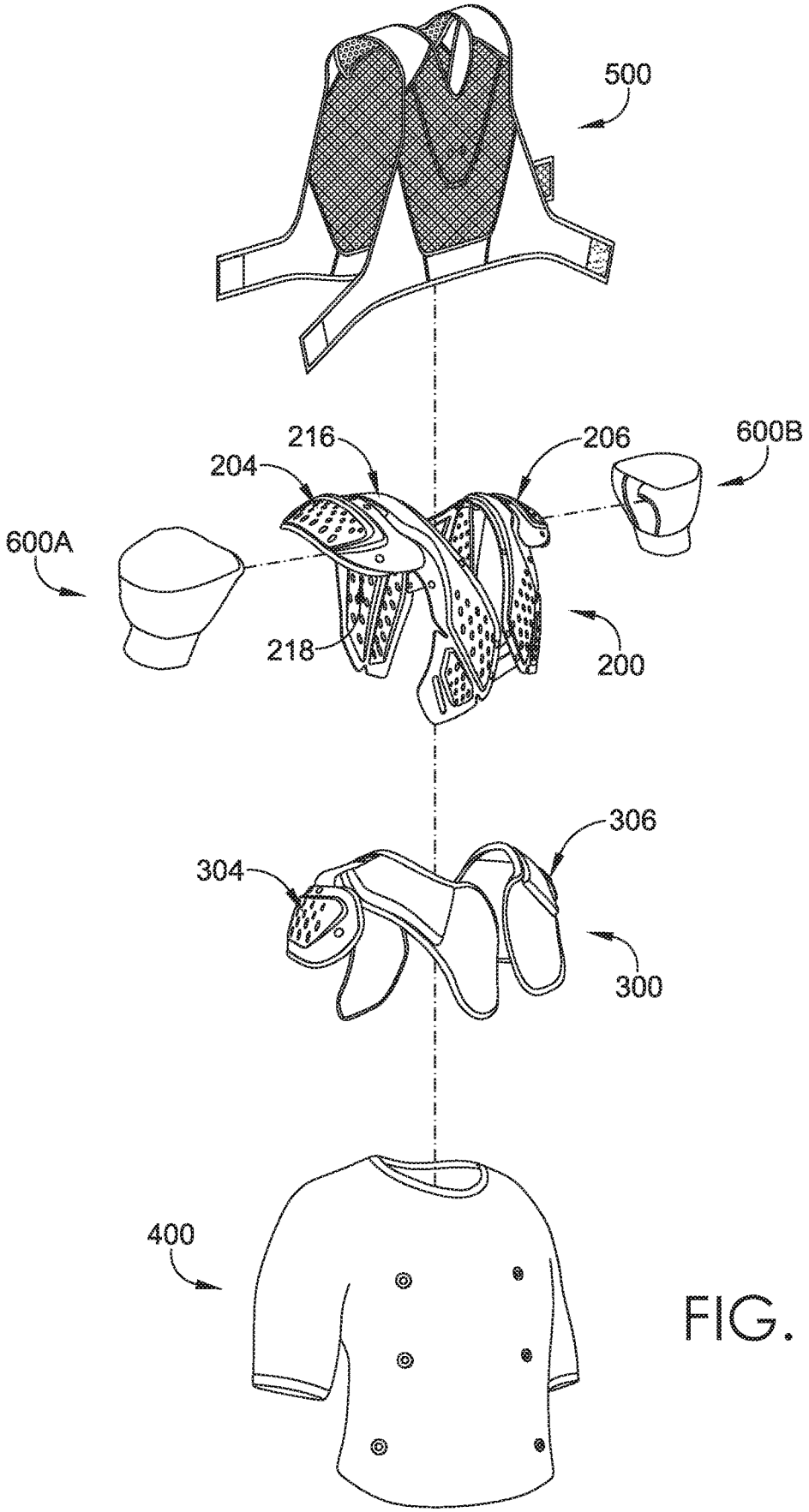
FIG. 4 depicts an exploded view of a shoulder-pad assembly in accordance with an aspect hereof.

Referring now to FIG. 4, the shoulder-pad system 100 is illustrated in an exploded view, which depicts various possible subcomponents of the shoulder-pad system 100. For example, the shoulder-pad system 100 includes an impact-plate assembly 200, an impact-attenuation sub-layer 300, and a base-layer garment 400. The base-layer garment 400 includes a variety of garments that may be worn directly under the impact-attenuation sub-layer, such as a sleeved shirt or sleeveless shirt. The impact-attenuation sub-layer is generally a cushion layer that is removably coupled to the garment 400 and that helps to absorb and/or attenuation at least some of the impact force from the impact-plate assembly 200. The impact-plate assembly 200 is generally more rigid (as compared with the garment 400 and the impact-attenuation sub-layer 300) and includes a set of impact plates that are coupled together (e.g., chest plate, upper back plate, epaulette, etc.). The plates of the impact-plate assembly 200 may be constructed of various materials having a higher rigidity, such as a polypropylene material, a styrene-butadiene copolymer material, carbon-fiber based material, and the like. Generally, the impact-attenuation sub-layer 300 is layered over the base-layer garment 400, and the impact-plate assembly 200 is layered over the impact-attenuation sub-layer 300.

In addition, the shoulder-pad system 100 includes various garments that fit onto, and at least partially around, different portions of the shoulder-pad system 100 in order to at least partially secure the portions of the shoulder-pad system together. In this sense, the garments may at least partially encase, wrap, or enclose portions of the shoulder-pad system. In addition, the garments may function to secure portions of the shoulder-pad system 100 to an athlete. For example, the shoulder-pad system 100 includes a securing garment 500 that is positionable over the impact-plate assembly 200 and that may be securable to the impact-plate assembly 200 and to one or more other garments (e.g., pants, belt, base layer(s), etc.). Furthermore, the shoulder-pad system 100 includes a pair of discrete shoulder sleeves 600A and 600B that are detached from other garment portions, such as the securing garment 500, base-layer garment 400, or other upper-body garments (e.g., uniform jersey), and that are attachable to other portions other portions of the system (e.g., to an epaulette plate). The various subcomponents depicted in FIG. 4 are exemplary of one aspect of the disclosure, and these subcomponents might be modified in various manners to includes additional, fewer, or different features.

The subcomponents in FIG. 4 might be worn or utilized in various contexts and manners. For instance, the base-layer garment 400 might be positioned onto an athlete initially. The base-layer garment 400 may include one or more releasable fasteners for a releasable coupling to the impact-attenuation sub-layer 300. Accordingly, the impact-attenuation sub-layer 300 may be coupled and decoupled with the base-layer garment 400 as desired or needed by the athlete. The impact-attenuation sub-layer 300 may also be attached to the base-layer garment 400 before the base-layer garment 400 is donned, such that the combination of the base-layer garment 400 coupled with the impact-attenuation sub-layer 300 may be donned or put on at the same time. The impact-plate assembly 200 may be positionable over the impact-attenuation sub-layer 300, such that at least part of the impact-attenuation sub-layer 300 is nested beneath shoulder portions of the impact-plate assembly 200. As can be appreciated, the impact-plate assembly 200 might be overlaid atop the impact-attenuation sub-layer 300 either before the athlete dons the impact-attenuation sub-layer 300 and base-layer garment 400, or while the impact-attenuation sub-layer 300 and base-layer garment 400 are being worn.

The impact-plate assembly 200 and the impact-attenuation sub-layer 300 may be substantially retained in a particular position or arrangement using various features. For example, the securing garment 500 may be overlaid atop the impact-plate assembly 200 and coupled to other portions of the shoulder-pad system 100, to other garments (e.g., pants, belt, base layers, etc.), to the athlete, or any combination thereof. The securing garment 500 is depicted as a bib garment (or a tank-style garment), and other aspects of the disclosure may include a number of other suitable upper-body garments for securing the impact plate assembly 200. The securing garment 500 may then be attached to one or more various anchor points on the impact plate assembly 200, on other garments (e.g., pants, belt, etc.), on the athlete, or any combination thereof. In addition, the discrete shoulder sleeves 600A and 600B are each securable around a portion of an arm of the athlete, as well as to a respective portion of the impact-plate assembly, such as to an epaulette plate (e.g., 204) of the impact-plate assembly, a respective shoulder-cap (e.g., 304) of the sub-layer, or both the epaulette plate and the shoulder-cap. In this respect, the discrete shoulder sleeves 600A and 600B are also securing garments that function to couple various portions of the shoulder-pad system 100 together and to the athlete.

The shoulder-pad system 100 may be described as modular, in that the various subcomponents may be added to, and/or removed from, the system when it is desirable to do so. In addition, the system is modular in the sense that one or more subcomponents may be selectively repositioned within the system without necessarily affecting a portion or function of other subcomponents. As such, the system may include one or more layers or sub-layers that are modular.

The one or more subcomponents of the shoulder-pad system 100 may be utilized in various contexts. For instance, the entire system 100 may be worn in certain circumstances, and in other occasions, only some of the subcomponents may be worn. For example, the base-layer garment 400 might initially be positioned onto an athlete, and one or more subcomponents may or may not be layered onto the base-layer garment 400 depending on the activity. If the athlete is engaging in warm-ups, conditioning, or non-contact drills, then the athlete may not layer the impact-attenuation sub-layer 300 onto the base-layer garment 400. Further, it may be desirable in other instances to include the impact-attenuation sub-layer 300 without the impact-plate assembly 200, such as in a 7-on-7 drill or other light-contact drills.

The various subcomponents each includes certain features and functionality that arise from the sub-component independently, as well as the synergistic interaction of the sub-component with one or more other subcomponents. Some of these aspects of the technology are generally described in this portion of the disclosure, and they will be described in more detail in other portions of the Specification. For example, one or more of the subcomponents may provide an amount of range of motion for a wearer, such as a shoulder range of motion or an arms-overhead range of motion. In addition, one or more of the subcomponents may provide system-stability features that improve the ability of the subcomponents to attenuate an impact and to remain in, or easily return to, a pre-impact state or arrangement. Additional features of the subcomponents may reduce or alleviate some maintenance often performed on more traditional padding systems, as well as improve the launderability of the subcomponents. Furthermore, one or more of the subcomponents may be customizable to a particular athlete or group of athletes. These features and functionality, as well as others, of the shoulder-pad system 100 and the various subcomponents will be described in additional detail in other parts of this disclosure.

Aspects of Exemplary Securing Garments

The remaining disclosure is directed to the securing garment 500 and the interaction between the securing garment 500 and the impact-plate assembly 200. It is understood that this disclosure equally applies to a shoulder-pad system 100 comprising these two sub-components as well as a shoulder-pad system 100 comprising three or four sub-components.

Figure 5:
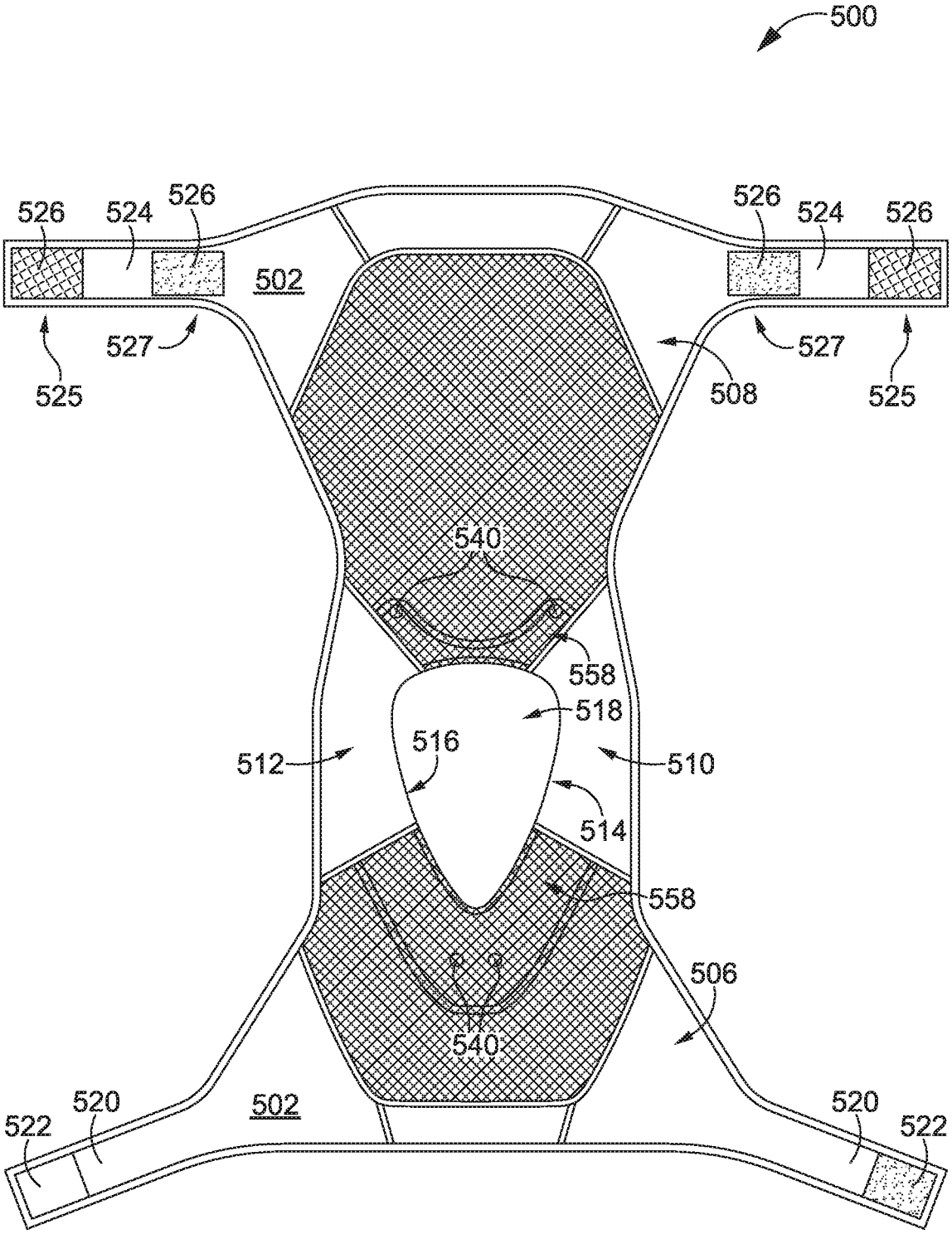
FIG. 5 depicts a plan view of an outward-facing side of an upper-body garment in accordance with an aspect hereof.
Figure 6:
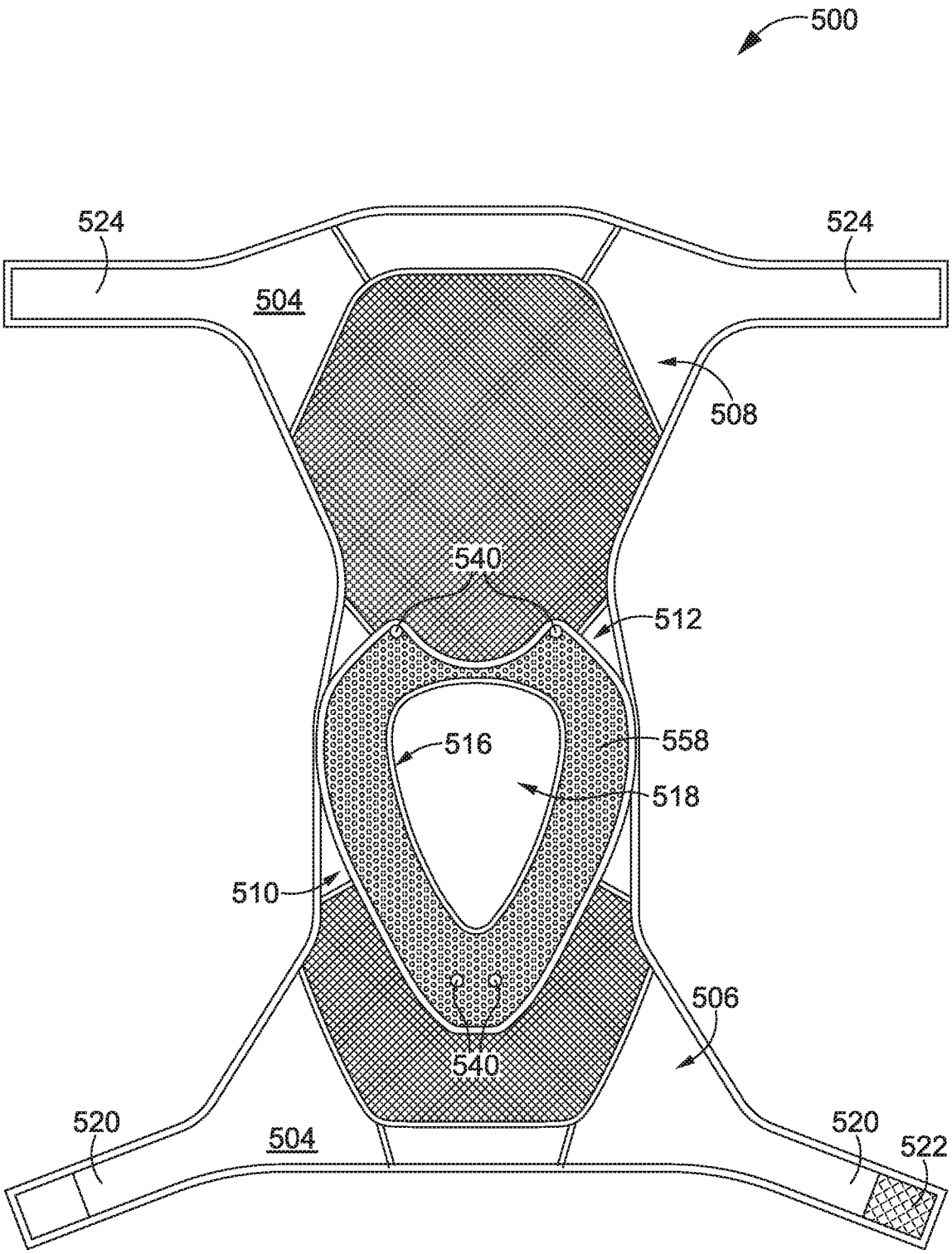
FIG. 6 depicts a plan view of an inward-facing side of an upper body garment in accordance with an aspect hereof.

Turning now to FIGS. 5 and 6, further aspects of the securing garment 500 will now be disclosed. The securing garment 500 may include an outward-facing surface 502 opposite of an inward-facing surface 504. An exemplary securing garment 500 is illustrated in FIG. 5 and is depicted laid flat to expose an outward-facing surface 502. In FIG. 6 the securing garment 500 and is depicted laid flat to expose an inward-facing surface 504. The description "outward-facing" refers to the orientation of a surface away from the impact-plate assembly 200, and the description "inward-facing" refers to the orientation of a surface towards the impact-plate assembly 200.

The exemplary securing garment 500 may include an anterior panel 506 connected to a posterior panel 508 at a first shoulder portion 510 and a second shoulder portion 512. The anterior panel 506, the posterior panel 508, or both the anterior panel 506 and the posterior panel 508 may comprise a unitary panel. In some other aspects, as depicted in FIGS. 5 and 6, the anterior panel 506 and the posterior panel 508 comprise a plurality of sub-panels that are affixed to one another, such as by stitching, bonding, welding, taping, and the like. Each of the sub-panels may comprise various textiles with various properties. For example, a sub-panel may be a knit, woven, or non-woven textile constructed of various material fibers, filaments, yarns, and the like. The sub-panels may also include zonal properties, such as a desired amount of breathability, cushion, insulation, moisture wicking, and the like. Further, the sub-panels may or may not include perforations or mesh construction.

The first and second shoulder portions 510, 512 may each include collar portions 514 that form a perimeter 516 around a garment neck-receiving opening 518. For example, the collar portions 514 may be the portion of the first and second shoulder portions 510, 512 immediately adjacent to the perimeter 516. In another aspect, the perimeter 516 may extend into the anterior region of the garment, the posterior region of the garment, or both the anterior region and the posterior region, such that the anterior panel 506, the posterior panel 508, or both the anterior panel 506 and the posterior panel 508 include collar portions 514.

In some aspects, the collar portions 514 include a first portion of one or more releasable fasteners 540. The first portion of the one or more releasable fasteners 540 may be coupled to the inward-facing surface 504 of the securing garment 500. The first portion of the one or more releasable fasteners 540 are each intended to couple to a second portion of the one or more releasable fasteners (not shown in FIGS. 5 and 6) affixed to an impact-plate assembly (e.g., the impact-plate assembly 200 of FIG. 2). In other aspects, the securing garment 500 includes a collar tab 558. For example, the exemplary securing garment 500 illustrated in FIGS. 5 and 6 includes the collar tab 558 extending from the perimeter 516 radially outward from the garment neck-receiving opening 518. The first portion of the one or more releasable fasteners 540 is coupled to the collar tab 558 in accordance with some aspects.

Figure 10:
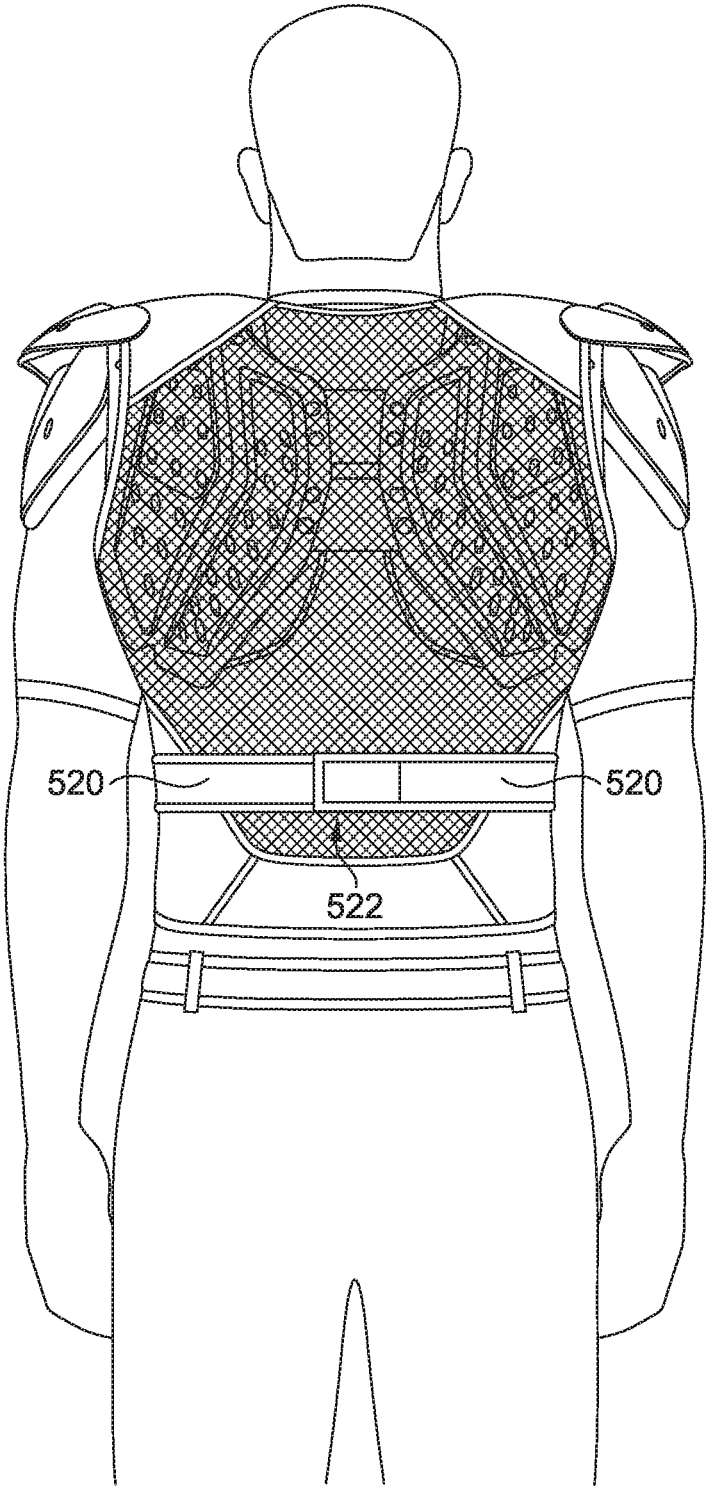
FIG. 10 depicts a rear view of at least part of a shoulder-pad assembly in an as-worn position in accordance with an aspect hereof.

The securing garment 500 may further include one or more first lateral panels 520 affixed to the anterior panel 506, the posterior panel 508, or a combination thereof. The exemplary securing garment 500 includes two first lateral panels 520 affixed to and extending from the anterior panel 506. The one or more first lateral panels 520 may include a first releasable fastener 522, such as a hook-and-loop fastener, a buckle, a clip, a male-and-female fastener (e.g., stud and socket, snap, etc.), button, and the like. For example, the first releasable fastener 522 is depicted as a hook and loop fastener. In some aspects, the one or more first lateral panels 520 may extend around the securing garment 500 when the securing garment 500 is in the as-worn position and couple to one another or couple to the outward-facing surface 502 of the posterior panel 508 (see e.g., FIGS. 10-12). In other aspects, the one or more first lateral panels 520 may be integrally formed in the anterior panel 506 or posterior panel 508.

In some aspects, the securing garment 500 may include one or more second lateral panels 524 affixed to the anterior panel 506, posterior panel 508, or a combination thereof. The exemplary securing garment 500 in FIGS. 5 and 6 includes two second lateral panels 524 affixed to and extending from the posterior panel 508. The one or more second lateral panels 524 may include one or more additional releasable fasteners 526, which may include any of a variety of fasteners, such as a hook-an-loop fastener, a male-and-female fastener, button, and the like. FIG. 5 depicts one exemplary aspect in which each of the second lateral panels 524 includes a distal portion 525 having a first part of the releasable fastener on the outward-facing surface and a proximal portion 527 having a second part of the releasable fastener that mates with the first part. In FIG. 5, the releasable fasteners 526 include hook-and-loop strips. In an aspect of the present invention, the distal portions 525 of the second lateral panels 524 are configured to wrap around an anchoring point on the impact-plate assembly 200 and releasably attach to the proximal portions (see e.g., FIG. 8).

Although the one or more first lateral panels 520 and the one or more second lateral panels 524 have each been described as configured to wrap in a certain arrangement around the securing garment 500 and/or around the impact-plate assembly 200, it is understood that the described positioning and coupling is not the only suitable way for providing same. For example, the anterior and posterior panels on a same lateral side of the garment may releasably connect to one another. For example, the right-side anterior panel may releasably connect to the right-side posterior panel, using any of a variety of releasable fasteners, such a hook-and-loop fastener, a buckle, a clip, a male-and-female fastener (e.g., stud and socket, snap, etc.), button, and the like.

Figure 7:
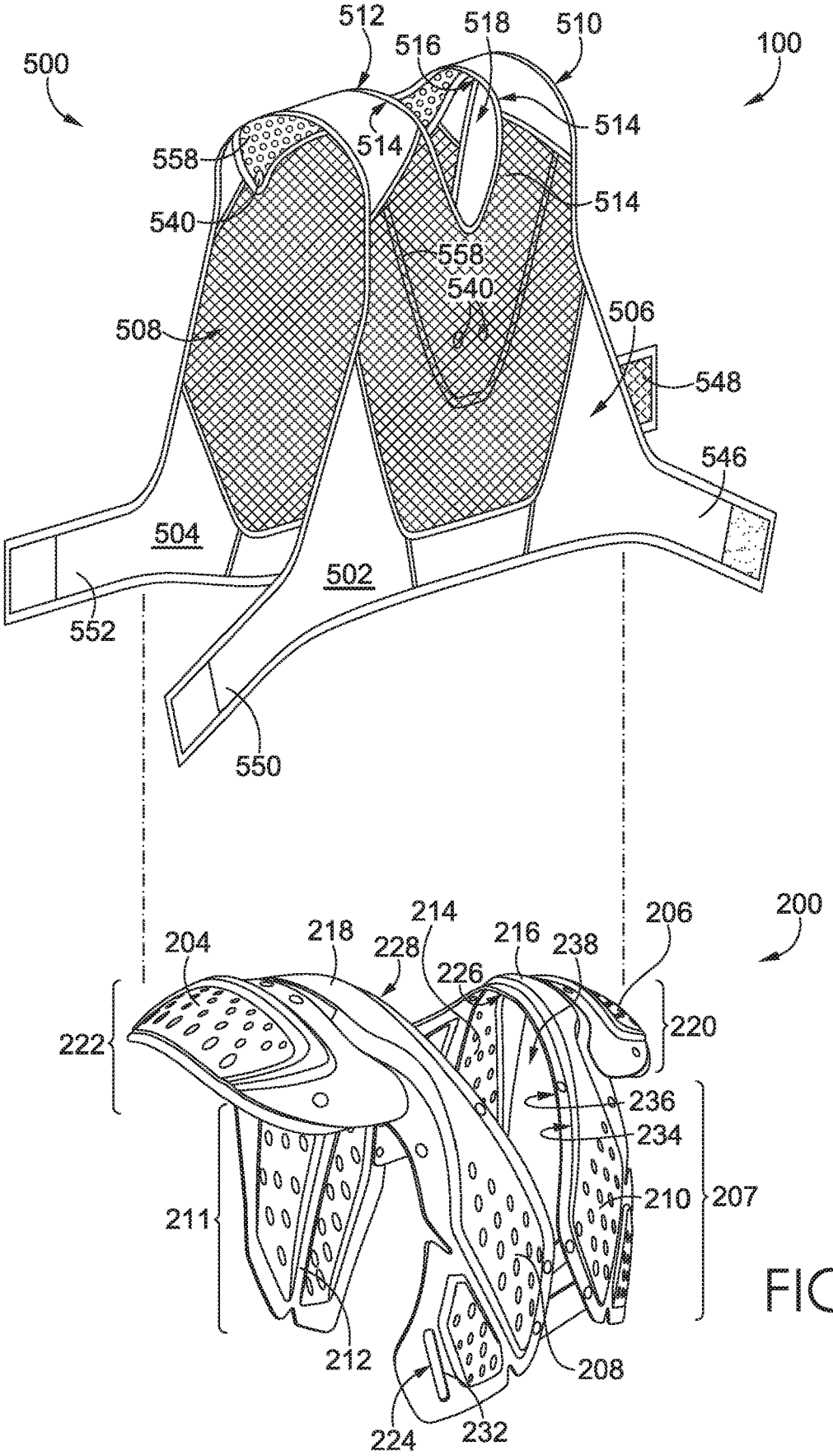
FIG. 7 depicts an exploded view of at least part of a shoulder-pad assembly in accordance with an aspect hereof.

Referring to FIG. 7, an exploded view of one aspect of the shoulder-pad system 100 is depicted. The illustrated aspect of the shoulder-pad system 100 includes the securing garment 500 and the impact-plate assembly 200. The securing garment 500 may be substantially as described above.

The impact-plate assembly 200 may include an anterior plate portion 207 coupled to a posterior plate portion 211 by a first shoulder assembly 220 and a second shoulder assembly 222. In some aspects, the anterior plate portion 207 includes a right anterior plate 208 coupled to a left anterior plate 210. The right anterior plate 208 may be affixed to, or releasably coupled to, the left anterior plate 210. For example, the right anterior plate 208 may releasably couple to the left anterior plate 210 by a lacing system. In other aspects, the anterior plate portion 207 may comprise a unitary anterior plate.

Similarly, the posterior plate portion 211 may comprise a right posterior plate 212 and a left posterior plate 214. In other aspects, the posterior plate portion 211 may comprise a unitary posterior plate. The right posterior plate 212 may be affixed to, or releasably coupled to, the left posterior plate 214.

The first shoulder assembly 220 may include a left epaulette 206 and a first arched frame 226 having a convex, crown-side surface 216 opposite a concave, underneath surface 226, and the first shoulder assembly 220 may connect the anterior plate portion 207 to the posterior plate portion 211. Likewise, the second shoulder assembly 222 may include a right epaulette 204 and a second arched frame 228 having a convex, crown-side surface 218 opposite a concave, underneath surface (obscured from view in FIG. 7), and the second shoulder assembly 222 may connect the anterior plate portion 207 to the posterior plate portion 211.

The first and second arched frames 226, 228 may each include plate collar portions 234 that form a plate perimeter edge 236 around a plate neck-receiving opening 238. For example, the plate collar portions 234 may be the portion of the first and second arched frames 226, 228 immediately adjacent to the plate perimeter edge 236. In another aspect, the plate perimeter edge 236 may extend into the anterior region of the system, the posterior region of the system, or both the anterior region and the posterior region, such that the anterior plate portion 207, the posterior plate portion 211, or both the anterior plate portion 207 and the posterior plate portion 211 include plate collar portions 234.

In some aspects, the plate collar portions 234 include the second portion of the one or more releasable fasteners (that mate with fasteners 540) referenced above. For example, the plate collar portions 234 may include a mating part of a male-female coupling (e.g., snap) that allows the fasteners 540 of the garment 500 to attach to the impact-plate assembly 200. The second portion of the one or more releasable fasteners may be affixed to an outward-facing surface of the impact-plate assembly 200. In other aspects, the second portion of the one or more releasable fasteners 244 may be affixed to the underneath surface 242. For example, in aspects where the securing garment 500 includes the collar tab 558 having the first portion of the one or more releasable fasteners 540 affixed thereto, the collar tab 558 may extend through the plate neck-receiving opening 238 and wrap around the plate perimeter edge 236 such that the collar tab 558 extends substantially along the underneath surface 242 of the impact-plate assembly 200.

Figure 8:
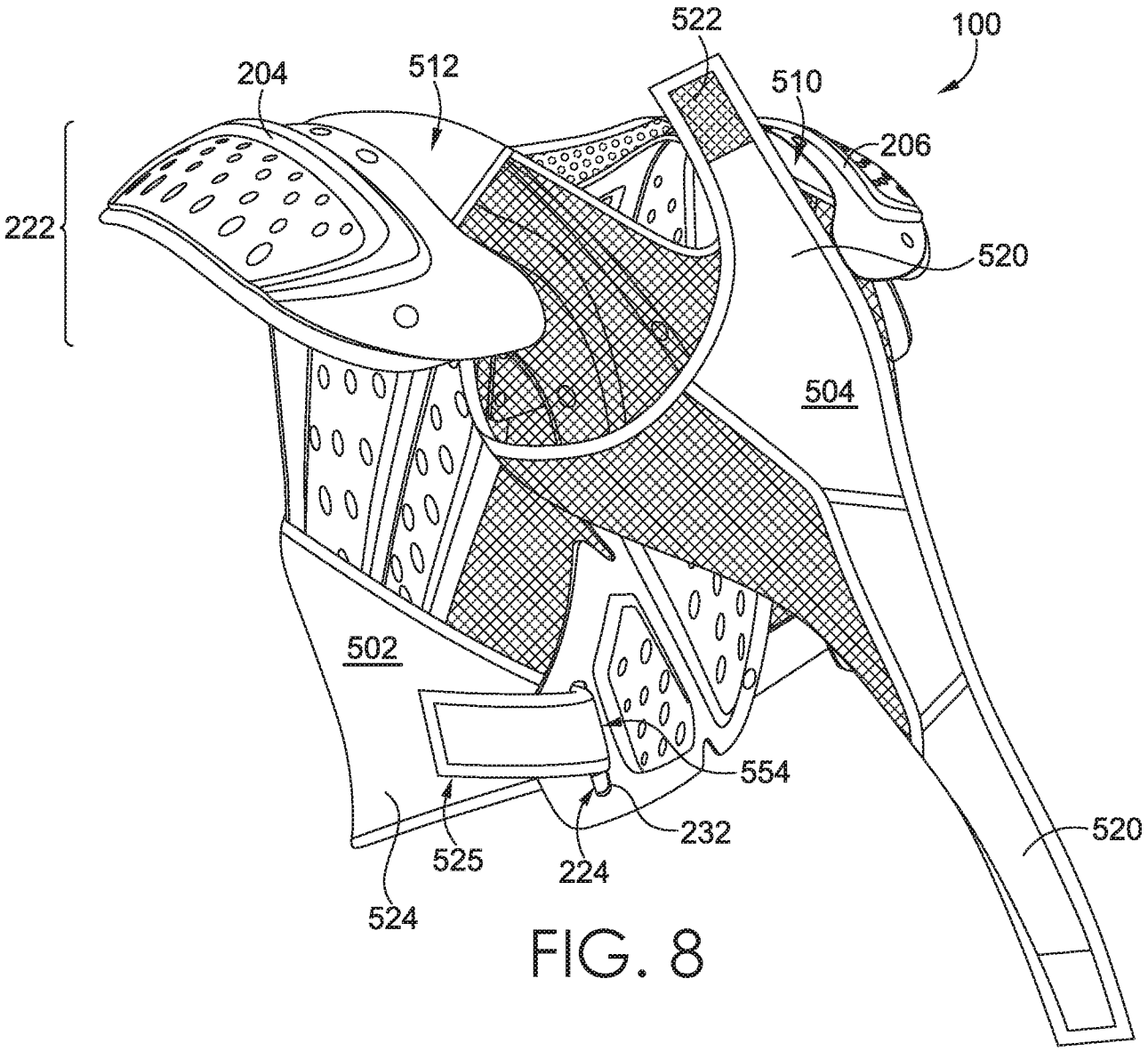
FIG. 8 depicts a perspective view of a partially assembled shoulder-pad assembly in accordance with an aspect hereof.

Referring to FIG. 8, an aspect of the shoulder-pad system 100 is depicted and includes one or more first garment anchors 224 and one or more second garment anchors 554. For example, in some aspects of the disclosure, the anterior plate portion 207 may include the one or more first garment anchors 224. The one or more first garment anchors 224 may comprise a first lateral slot (obscured from view) extending through the left anterior plate 210 and a second lateral slot 232 extending through the right anterior plate 208. The first lateral slot may slidably receive a left-side lateral panel that extends form the posterior panel of the securing garment 500 and the second lateral slot 232 may slidably receive the distal portion 525 of the other lateral panel 524. In the illustrated aspect depicted in FIG. 8, the distal portion 525 of the other lateral panel 524 is threaded through the second lateral slot 232 and is coupled back onto an outward facing surface 502 of the panel 524. The left lateral side of the system may include a similar configuration. In this sense, the one or more second garment anchors 554 include the first and second posterior lateral panels 524, and the one or more first garment anchors 224 include the slots 232 extending through the anterior portion 207 of the plate assembly. The one or more first garment anchors 224 and the one or more second garment anchors may couple the securing garment 500 to the impact-plate assembly 200 to allow the securing garment 500 to hold the shoulder-pad system 100 in the as-worn position. For example, when the securing garment 500 and the impact-plate assembly 200 are in the as-worn position, the one or more first garment anchors 224 and the one or more second garment anchors 554 may restrain the impact-plate assembly 200 in at least the forward, rearward and lateral directions.

Referring to FIGS. 7 and 8, when donning the shoulder-pad system 100, the securing garment 500 may be draped over the impact-plate assembly 200 such that the first shoulder portion 510 overlays the convex, crown-side surface 216 and the second shoulder portion 512 overlays the convex, crown-side surface 218. The collar tab 558 may be inserted through the plate neck-receiving opening 238 and the one or more first portions of releasable fasteners 540 may be mated with the one or more second portions of releasable fasteners. In certain aspects, the one or more second garment anchors 554 of the securing garment 500 may be threaded through the one or more first garment anchors 224 of the impact-plate assembly 200. The one or more second garment anchors 554 may be coupled to the respective outward-facing surface 502, or otherwise secured to hold the securing garment 500 to the impact-plate assembly 200.

Figure 9:
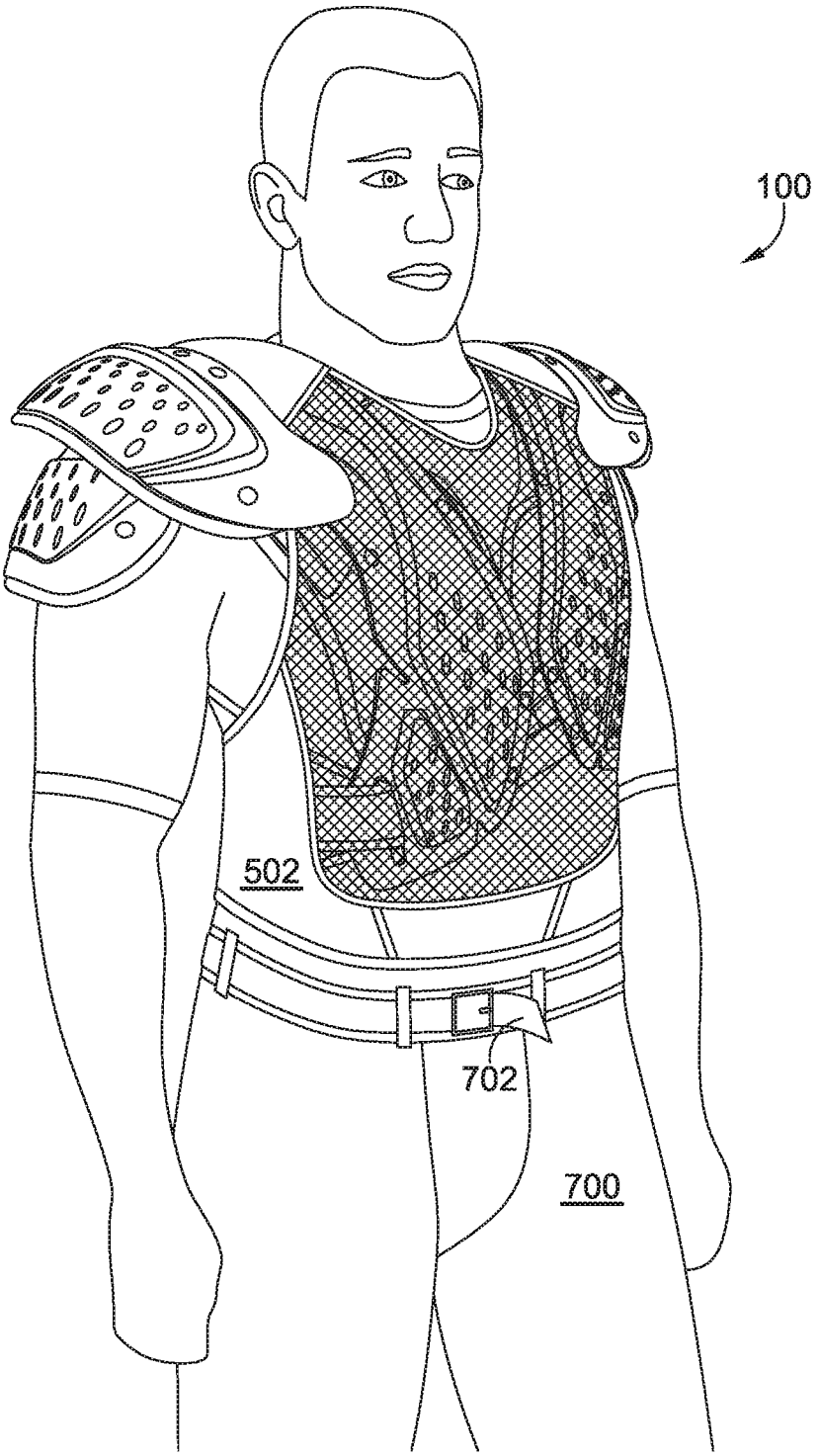
FIG. 9 depicts a perspective view of at least part of a shoulder-pad assembly in an as-worn position in accordance with an aspect hereof.

FIG. 9 illustratively depicts at least a portion of the system 100 after the first and second anchors have been coupled, as described with respect to FIG. 8. In addition, FIG. 10 further illustrates an aspect in which the first and second anterior lateral panels 520 have been wrapped around the securing garment 500 to the posterior side of the system and connected to one another, by way of the releasable fastener 522.

Figure 11:
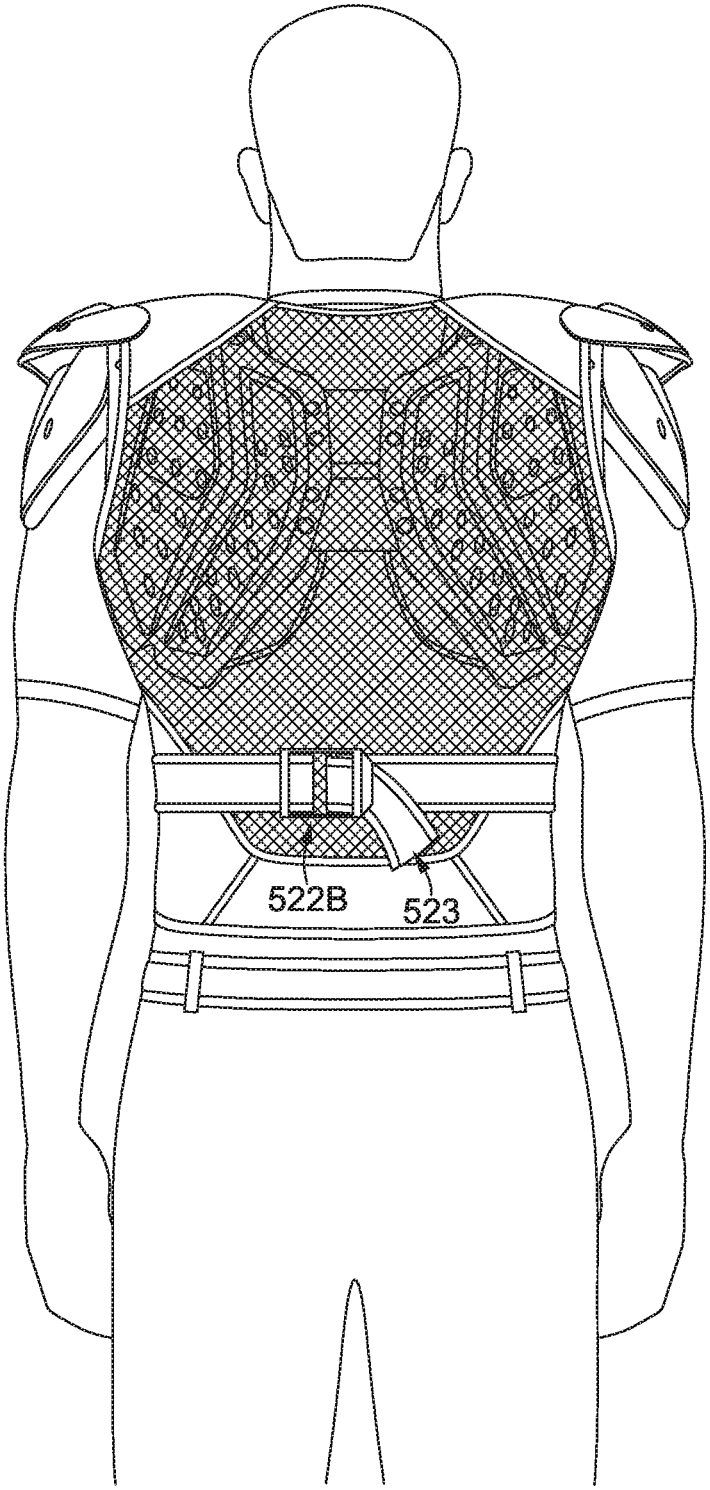
FIG. 11 depicts a rear view of at least part of an alternative shoulder-pad assembly in an as-worn position in accordance with an aspect hereof.

FIG. 11 depicts an alternative aspect in which an adjustable, releasable fastener 522B couples the first and second anterior lateral panels to one another. Although FIG. 11 depicts a buckle, other adjustable and releasable fasteners may also be utilized, such as a double-D buckle, in which the free end 523 may be pulled or loosed to adjust a fit of the garment.

Figure 12:
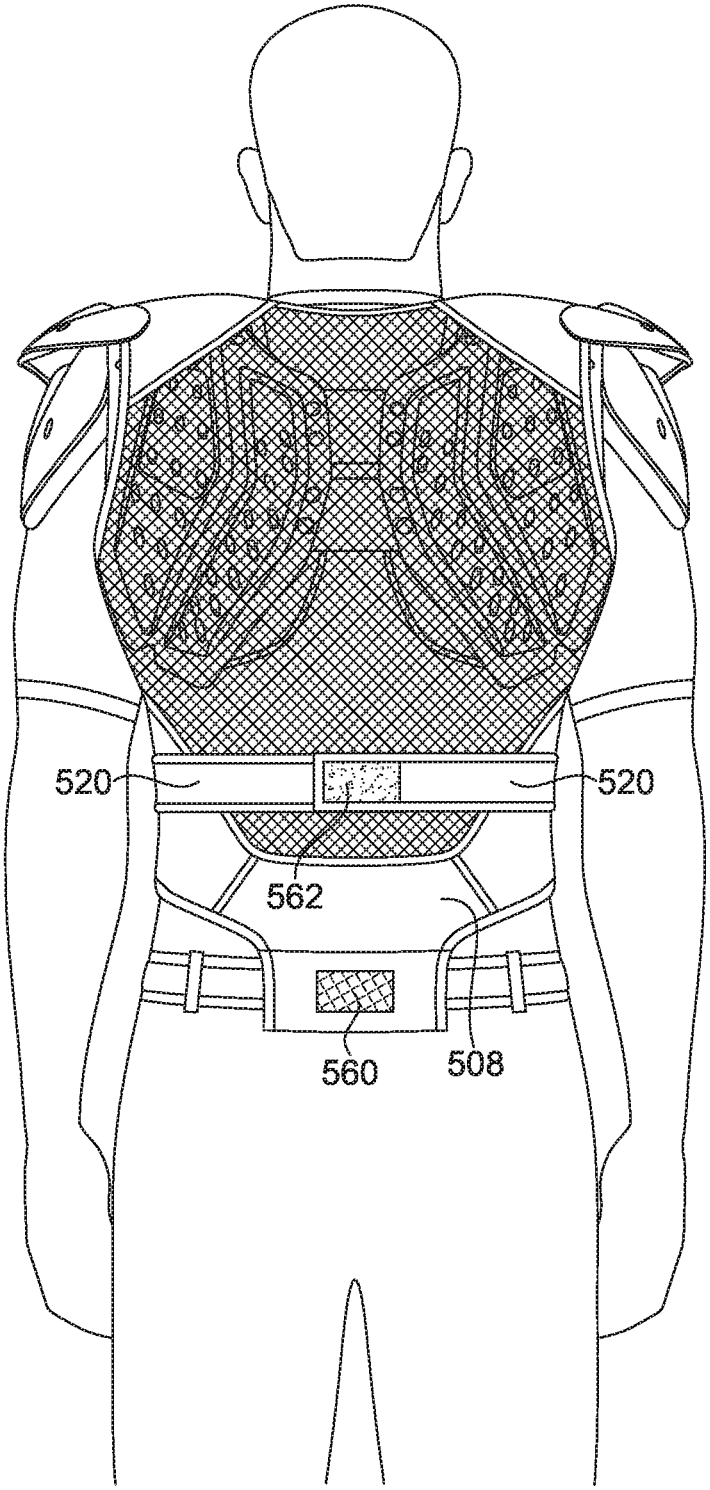
FIG. 12 depicts a rear view of at least part of another alternative shoulder-pad assembly in an as-worn position in accordance with an aspect hereof.

In another alternative aspect depicted in FIG. 12, the posterior panel 508 may include a panel extension 530 that extends from an inferior portion (i.e., bottom portion) of the posterior panel 508. The panel extension 530 includes another releasable fastener 560 that releasably mates with a corresponding releasable fastener 562. Although an exemplary hook-and-loop mechanism is depicted in FIG. 12, any of a variety of other suitable releasable fasteners may also be utilized. In operation, the panel extension 530 may be folded upward and affixed to the first and second anterior lateral panels 520 to further secure the connection between the panels 520.

Figure 13:
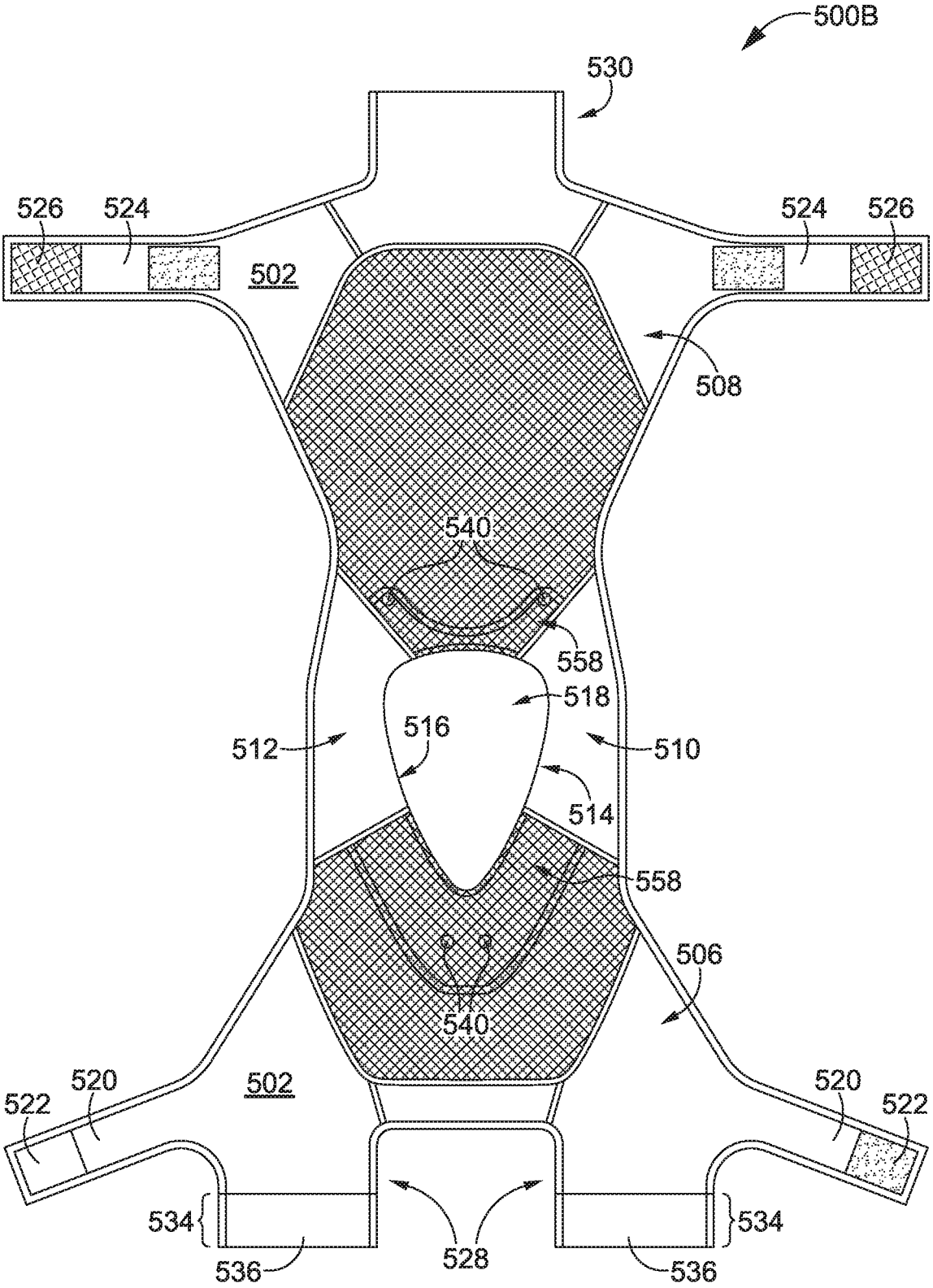
FIG. 13 depicts a plan view of an outward-facing side of another upper-body garment in accordance with an aspect hereof.

Referring now to FIG. 13, an alternative aspect of a securing garment 500B is illustratively depicted. The anterior panel 506 may further include one or more anterior panel extensions 528 extending away from the collar portions 514. Likewise, the posterior panel 508 may further include one or more posterior panel extensions 530. The anterior panel extensions 528 and the posterior panel extensions 530 may include one or more belt-attachment mechanisms 534, one or more releasable attachment mechanisms, or a combination thereof. The one or more belt-attachment mechanisms 534 and the one or more releasable attachment mechanisms are configured to releasably couple the securing garment 500B to a lower-body garment, such as a belt garment 702 (depicted in FIG. 9).

In one aspect, the one or more belt-attachment mechanisms 534 may comprise belt loops 536 configured to receive a belt garment 702 (shown in FIG. 9) therethrough to couple the securing garment 500B to the lower-body garment 700. In another aspect, the one or more releasable attachment mechanisms may comprise clamps (e.g., alligator clips), buckles, buttons, snaps, and the like configured to couple to the lower-body garment 700 or the belt garment 702. In yet another aspect, the one or more releasable attachment mechanisms may comprise the first portions of releasable fasteners configured to releasably mate with the second portions of releasable fasteners affixed to the lower-body garment 700.

Figure 14:
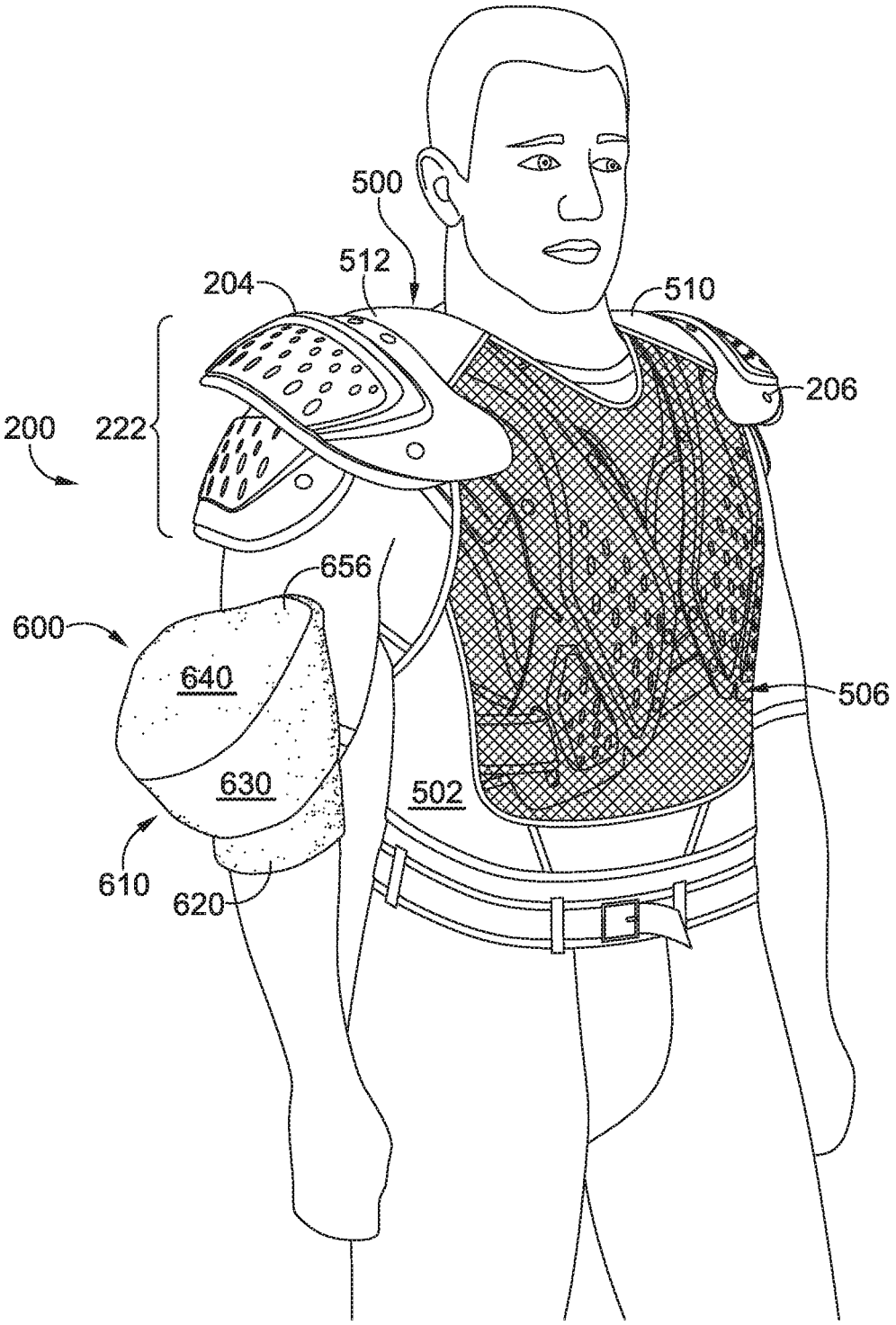
FIG. 14 depicts a perspective view of at least part of a shoulder-pad assembly having a discrete shoulder sleeve and an upper-body securing garment in an as-worn position in accordance with an aspect hereof.

Turning now to FIG. 14, another aspect is illustrated that includes a combination of the impact-plate assembly 200, the upper-body securing garment 500, and a discrete shoulder sleeve 600 that is detached from the upper-body securing garment 500. The detached shoulder sleeve 600 may include at least some of the features described in related U.S. patent application No. 62/319,664 (titled "Discrete Shoulder Sleeve for a Shoulder-pad System" and filed on Apr. 7, 2016), which is incorporated herein by reference in its entirety.

In FIG. 14, the set of shoulder pads includes an anterior plate portion (e.g., FIG. 7, element 207), a posterior plate portion (e.g., FIG. 7, element 211), a first shoulder assembly (e.g., FIG. 7, element 220), and a second shoulder assembly 222. In addition, the anterior plate portion includes one or more first garment anchors, such as the slot 232. The first and second shoulder assemblies include a first and second arched frames (e.g., 226 and 228), respectively, and a first and second epaulette plate 206 and 204. The upper-body garment 500 fits over, and at least partially covers, the impact-plate assembly 200. For example, an anterior panel 506 at least partially covers the anterior plate portion, and a posterior panel (obscured from view) at least partially covers the posterior plate portion. The anterior and posterior panels are coupled to one another by a first shoulder portion 510 and a second shoulder portion 512. The first shoulder portion of the upper-body garment wraps over the first arched frame of the first shoulder assembly and is layered over the convex, crown-side surface of the first arched frame. In addition, the second shoulder portion of the upper-body garment wraps over the second arched frame of the second shoulder assembly and is layered over the convex, crown-side surface of the second arched frame. One or more second garment anchors are attached to the upper-body garment and are configured to releasably attach to the one or more first garment anchors (see e.g., FIG. 8). FIG. 14 also depicts the discrete shoulder sleeve 600 that is removably attachable to the epaulette plate 204. The discrete shoulder sleeve includes an epaulette attachment mechanism (e.g., slot encased by portion 656) and a shoulder pocket 610 coupled with the epaulette attachment mechanism. The shoulder pocket includes one or more textile panels 630 and 640 coupled to one another to form a cavity, the one or more textile panels at least partially encasing the epaulette when the epaulette is positioned in the cavity. The discrete shoulder sleeve 600 further includes a cuff 620 coupled to the shoulder pocket 610 and including a band of textile forming a tubular body.

The discrete shoulder sleeve 600 is completely detached from the upper body garment 500. As such, in some aspects the discrete shoulder sleeve 600 may provide larger overhead range of motion, as compared with a traditional upper body garment with attached sleeves. That is, absent the present disclosure, the sleeves of a traditional upper body garment may impede full range of motion on account of the attachment of the sleeve to the upper-body garment in the armpit region of the garment, in the shoulder region of the garment, or a combination thereof. However, the discrete shoulder sleeve 600 is allowed to move independently of the rest of the upper body garment, such that the discrete shoulder sleeve is not pulled downward by the attachment to the upper body garment with a wearer extends arms overhead. As such, in a further aspect, the discrete shoulder sleeve, the upper body garment, or both the securing sleeve and the upper body garment may replace a traditional sleeved uniform, and the discrete shoulder sleeve 600 the upper body garment 500 may include identifying indicia, such as a team logo, colors, player identifiers (e.g., name, number, etc.), and the like.

From the foregoing, it will be seen that this subject matter is adapted to attain all the ends and objects hereinabove set forth together with other advantages, which are obvious and which are inherent to the structure. It will be understood that certain features and subcombinations are of utility and may be employed without reference to other features and subcombinations. This is contemplated by and is within the scope of the claims. Since many possible variations and alternatives may be made without departing from the scope thereof, it is to be understood that all matter herein set forth or shown in the accompanying drawings is to be interpreted as illustrative and not in a limiting sense.

What is claimed is:

1. A shoulder-pad system comprising:

a set of shoulder pads comprising an anterior plate portion, a posterior plate portion, a first shoulder assembly, and a second shoulder assembly, wherein the anterior plate portion includes one or more first garment anchors; and wherein the first and second shoulder assemblies include a first arched frame and a second arched frame, respectively, and a first and second epaulette plate, respectively;

an upper-body garment that fits over, and at least partially covers, the set of shoulder pads, when in an as-worn configuration, the upper-body garment comprising:

an anterior textile panel at least partially covering an outer surface of the anterior plate portion;

a posterior textile panel at least partially covering an outer surface of the posterior plate portion and connected to the anterior textile panel by a first shoulder portion and a second shoulder portion, wherein the anterior textile panel, the posterior textile panel, and the first and second shoulder portions each includes a respective garment collar portion forming a garment perimeter edge around a garment neck-receiving opening, wherein the anterior textile panel extends from the garment collar portion of the anterior textile panel to a position past an inferior edge of the anterior plate portion, when in the as-worn configuration;

the first shoulder portion of the upper-body garment wrapping over the first arched frame of the first shoulder assembly and layered over a convex, crown-side surface of the first arched frame;

the second shoulder portion of the upper-body garment wrapping over the second arched frame of the second shoulder assembly and layered over a convex, crown-side surface of the second arched frame; and one or more second garment anchors attached to the upper-body garment and configured to releasably attach to the one or more first garment anchors; and a first discrete shoulder sleeve that is removably attachable to the first epaulette plate and a second discrete shoulder sleeve that is removably attachable to the second epaulette plate, the first and second discrete shoulder sleeves each including:

a shoulder pocket including one or more shoulder pocket textile panels coupled to one another to form a cavity, the one or more shoulder pocket textile panels at least partially encasing one of the first and second epaulette plates when the one of the first and second epaulette plates is positioned in the cavity, and a cuff coupled to the shoulder pocket and including a band of textile forming a tubular body, wherein the first and second discrete shoulder sleeves are detached from the upper-body garment, wherein the one or more first garment anchors includes a first lateral slot and a second lateral slot, and wherein the one or more second garment anchors includes a first posterior lateral panel and a second posterior lateral panel, the first posterior lateral panel extending from the posterior textile panel and being slidably threaded through the first lateral slot and the second posterior panel lateral panel extending from the posterior textile panel and being slidably threaded through the second lateral slot.

2. The shoulder-pad system of claim 1, wherein each of the first and second epaulette plates includes an epaulette profile;

wherein the one or more shoulder pocket textile panels includes a top panel, the top panel including a panel shape that at least partially corresponds with the epaulette profile; and wherein the epaulette profile includes at least one protruding edge, and wherein the top panel includes at least one corresponding protruding portion coupled to a side panel of the one or more shoulder pocket textile panels.

3. The shoulder-pad system of claim 1, wherein the upper-body garment, the first discrete shoulder sleeve, and the second discrete shoulder sleeve comprise a uniform having identifying indicia on an outward facing surface.

4. The shoulder-pad system of claim 1, wherein the posterior textile panel extends from the first shoulder portion to the one or more second garment anchors of the upper-body garment.

5. A shoulder-pad system comprising:

a set of shoulder pads comprising an anterior plate portion, a posterior plate portion, a first shoulder assembly, and a second shoulder assembly, wherein the anterior plate portion includes one or more first garment anchors; and wherein the first and second shoulder assemblies include a first arched frame and a second arched frame, respectively, and a first and second epaulette plate, respectively;

an upper-body garment that fits over, and at least partially covers, the set of shoulder pads, when in an as-worn configuration, the upper-body garment comprising:

an anterior textile panel at least partially covering an outer surface of the anterior plate portion;

a posterior textile panel at least partially covering an outer surface of the posterior plate portion and connected to the anterior textile panel by a first shoulder portion and a second shoulder portion, wherein the anterior textile panel, the posterior textile panel, and the first and second shoulder portions each includes a respective garment collar portion forming a garment perimeter edge around a garment neck-receiving opening, wherein the anterior textile panel extends from the garment collar portion of the anterior textile panel to a position past an inferior edge of the anterior plate portion, when in the as-worn configuration;

the first shoulder portion of the upper-body garment wrapping over the first arched frame of the first shoulder assembly and layered over a convex, crown-side surface of the first arched frame;

the second shoulder portion of the upper-body garment wrapping over the second arched frame of the second shoulder assembly and layered over a convex, crown-side surface of the second arched frame; and one or more second garment anchors attached to the upper-body garment and configured to releasably attach to the one or more first garment anchors; and a first discrete shoulder sleeve that is removably attachable to the first epaulette plate and a second discrete shoulder sleeve that is removably attachable to the second epaulette plate, the first and second discrete shoulder sleeves each including:

a shoulder pocket including one or more shoulder pocket textile panels coupled to one another to form a cavity, the one or more shoulder pocket textile panels at least partially encasing Insert one of the first and second epaulette plates when the one of the first and second epaulette plates is positioned in the cavity, and a cuff coupled to the shoulder pocket and including a band of textile forming a tubular body, wherein the first and second discrete shoulder sleeves are detached from the upper-body garment, wherein the posterior textile panel extends from the first shoulder portion to the one or more second garment anchors of the upper-body garment.

6. The shoulder-pad system of claim 5, wherein the one or more first garment anchors includes a first lateral slot and a second lateral slot, and wherein the one or more second garment anchors includes a first posterior lateral panel and a second posterior lateral panel, the first posterior lateral panel extending from the posterior textile panel and being slidably threaded through the first lateral slot and the second posterior panel lateral panel extending from the posterior textile panel and being slidably threaded through the second lateral slot.

7. The shoulder-pad system of claim 5, wherein each of the first and second epaulette plates includes an epaulette profile;

wherein the one or more shoulder pocket textile panels includes a top panel, the top panel including a panel shape that at least partially corresponds with the epaulette profile; and wherein the epaulette profile includes at least one protruding edge, and wherein the top panel includes at least one corresponding protruding portion coupled to a side panel of the one or more shoulder pocket textile panels.

8. The shoulder-pad system of claim 5, wherein the upper-body garment, the first discrete shoulder sleeve, and the second discrete shoulder sleeve comprise a uniform having identifying indicia on an outward facing surface.

* * * * *